US008763542B2

(12) United States Patent
Abe et al.

(10) Patent No.: US 8,763,542 B2
(45) Date of Patent: Jul. 1, 2014

(54) SEWING MACHINE AND NON-TRANSITORY COMPUTER-READABLE MEDIUM

(71) Applicants: Daisuke Abe, Nagoya (JP); Yoshio Nishimura, Nagoya (JP); Yoshinori Nakamura, Toyohashi (JP); Satoru Ichiyanagi, Nagoya (JP); Yutaka Nomura, Anjo (JP); Akie Shimizu, Nagoya (JP); Yuki Ihira, Kakamigahara (JP)

(72) Inventors: Daisuke Abe, Nagoya (JP); Yoshio Nishimura, Nagoya (JP); Yoshinori Nakamura, Toyohashi (JP); Satoru Ichiyanagi, Nagoya (JP); Yutaka Nomura, Anjo (JP); Akie Shimizu, Nagoya (JP); Yuki Ihira, Kakamigahara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/971,299

(22) Filed: Aug. 20, 2013

(65) Prior Publication Data

US 2014/0060407 A1 Mar. 6, 2014

(30) Foreign Application Priority Data

Aug. 28, 2012 (JP) ..... 2012-187241

(51) Int. Cl.

| | |
|---|---|
| ***D05B 21/00*** | (2006.01) |
| ***D05C 5/02*** | (2006.01) |
| *D05B 35/12* | (2006.01) |
| *G06F 7/60* | (2006.01) |

(52) U.S. Cl.
USPC ..... 112/102.5; 112/475.18; 700/138

(58) Field of Classification Search
USPC ..... 112/98–103, 470.01–470.09, 470.14, 112/470.17, 470.18, 475.01, 475.05, 112/475.08, 475.17, 475.18, 475.19; 700/136–138
See application file for complete search history.

(56) References Cited

U.S. PATENT DOCUMENTS

| | | | | |
|---|---|---|---|---|
| 889,614 | A * | 6/1908 | Johnsen | 112/475.18 |
| 1,511,366 | A * | 10/1924 | Rapp et al. | 112/470.21 |
| 5,323,722 | A | 6/1994 | Goto et al. | |
| 5,553,559 | A | 9/1996 | Inoue et al. | |
| 5,943,972 | A | 8/1999 | Hirata | |
| 7,854,207 | B2 * | 12/2010 | Kuki et al. | 112/102.5 |
| 8,596,210 | B2 * | 12/2013 | Tokura | 112/470.06 |
| 2008/0216724 | A1 * | 9/2008 | Suzuki et al. | 112/470.03 |
| 2010/0242817 | A1 | 9/2010 | Tokura | |

FOREIGN PATENT DOCUMENTS

| | | |
|---|---|---|
| JP | A-57-35059 | 2/1982 |
| JP | A-4-30891 | 2/1992 |
| JP | A-5-68760 | 3/1993 |
| JP | A-6-319879 | 11/1994 |
| JP | A-11-244561 | 9/1999 |
| JP | A-2003-93770 | 4/2003 |
| JP | A-2010-246885 | 11/2010 |

* cited by examiner

*Primary Examiner* — Ismael Izaguirre
(74) *Attorney, Agent, or Firm* — Oliff PLC

(57) ABSTRACT

A sewing machine includes a sewing device, a processor, and a memory. The sewing device is configured to form stitches on a sewing workpiece. The memory is to store computer-readable instructions that, when executed by the processor, instruct the processor to perform processes including acquiring embroidery data, generating stitched marker data, causing the sewing device to sew the at least one stitched marker, causing the sewing device to start sewing an embroidery pattern, identifying a pattern to be sewn when the sewing of the embroidery pattern is stopped, detecting at least one of a second sewing position and a second sewing angle when the sewing of the embroidery pattern is stopped, setting at least one of a third sewing position and a third sewing angle, correcting data to be used to sew the pattern to be sewn, and causing the sewing device to restart sewing the embroidery pattern.

12 Claims, 14 Drawing Sheets

SEWING MACHINE AND NON-TRANSITORY COMPUTER-READABLE MEDIUM

CROSS-REFERENCE TO RELATED APPLICATION

This application claims priority to Japanese Patent Application No. 2012-187241 filed Aug. 28, 2012, the content of which is hereby incorporated herein by reference in its entirety.

BACKGROUND

The present disclosure relates to a sewing machine that can sew an embroidery pattern on a sewing workpiece held by an embroidery frame, and to a non-transitory computer-readable medium.

In a sewing machine that has a function of sewing an embroidery pattern on a sewing workpiece held by an embroidery frame, various functions that set a layout of the embroidery pattern on the sewing workpiece are being considered. In a known sewing machine, in a case where a plurality of embroidery patterns are combined and sewn, when an embroidery pattern that is first in sewing order is sewn, a stitch that indicates a reference position of the embroidery pattern is sewn.

SUMMARY

In the known sewing machine, when the position of at least one stitch to be sewn is adjusted with respect to at least one sewn stitch, a user has to arrange the stitch indicating the reference position in a position that is to be a needle drop point when sewing of each embroidery pattern is started, and thus the position adjustment operation is troublesome.

Embodiments of the broad principles derived herein provide a sewing machine capable of easily performing position adjustment of at least one stitch to be sewn with respect to at least one sewn stitch, and a non-transitory computer-readable medium.

Embodiments provide a sewing machine that includes a sewing device, a processor, and a memory. The sewing device is configured to form stitches on a sewing workpiece held by an embroidery frame. The memory is to store computer-readable instructions that, when executed by the processor, instruct the processor to perform processes including: acquiring embroidery data, the embroidery data being data to sew an embroidery pattern on the sewing workpiece, the embroidery pattern being formed by a plurality of stitches; generating stitched marker data based on the acquired embroidery data, the stitched marker data being data to form at least one stitched marker in a position where the at least one stitched marker is covered by the embroidery pattern, and each of the at least one stitched marker being formed by at least one stitch used as a reference for at least one of a first sewing position and a first sewing angle of the embroidery pattern; causing the sewing device to sew the at least one stitched marker in accordance with the generated stitched marker data; causing the sewing device to start sewing the embroidery pattern in accordance with the acquired embroidery data; identifying a pattern to be sewn when the sewing of the embroidery pattern is stopped, the pattern to be sewn having at least one stitch included in the plurality of stitches of the embroidery pattern and not yet sewn; detecting at least one of a second sewing position and a second sewing angle of the at least one stitched marker on the sewing workpiece when the sewing of the embroidery pattern is stopped; setting at least one of a third sewing position and a third sewing angle of the identified pattern to be sewn, in accordance with at least one of a fourth sewing position and a fourth sewing angle of a sewn pattern on the sewing workpiece, based on the detected at least one of the second sewing position and the second sewing angle, the sewn pattern having at least one sewn stitch that is included in the plurality of stitches of the embroidery pattern; correcting data to be used to sew the pattern to be sewn included in the embroidery data based on the set at least one of the third sewing position and the third sewing angle; and causing the sewing device to restart sewing the embroidery pattern in accordance with the embroidery data including the corrected data for the pattern to be sewn.

Embodiments farther provide a non-transitory computer-readable medium storing computer-readable instructions. The computer-readable instructions, when executed, instruct a processor of a sewing machine to perform processes including: acquiring embroidery data, the embroidery data being data to sew an embroidery pattern on a sewing workpiece held by an embroidery frame, the embroidery pattern being formed by a plurality of stitches; generating stitched marker data based on the acquired embroidery data, the stitched marker data being data to form at least one stitched marker in a position where the at least one stitched marker is covered by the embroidery pattern, and each of the at least one stitched marker being formed by at least one stitch used as a reference for at least one of a first sewing position and a first sewing angle of the embroidery pattern; causing a sewing device to sew the at least one stitched marker in accordance with the generated stitched marker data, the sewing device being configured to form stitches on the sewing workpiece held by an embroidery frame; causing the sewing device of the sewing machine to start sewing the embroidery pattern in accordance with the acquired embroidery data; identifying a pattern to be sewn when the sewing of the embroidery pattern is stopped, the pattern to be sewn having at least one stitch included in the plurality of stitches of the embroidery pattern and not yet sewn; detecting at least one of a second sewing position and a second sewing angle of the at least one stitched marker on the sewing workpiece when the sewing of the embroidery pattern is stopped; setting at least one of a third sewing position and a third sewing angle of the identified pattern to be sewn, in accordance with at least one of a fourth sewing position and a fourth sewing angle of a sewn pattern on the sewing workpiece, based on the detected at least one of the second sewing position and the second sewing angle, the sewn pattern having at least one sewn stitch that is included in the plurality of stitches of the embroidery pattern; correcting data to be used to sew the pattern to be sewn included in the embroidery data based on the set at least one of the third sewing position and the third sewing angle; and causing the sewing device to restart sewing the embroidery pattern in accordance with the embroidery data including the corrected data for the pattern to be sewn.

BRIEF DESCRIPTION OF THE DRAWINGS

Embodiments will be described below in detail with reference to the accompanying drawings in which.

DETAILED DESCRIPTION

Figure 1:
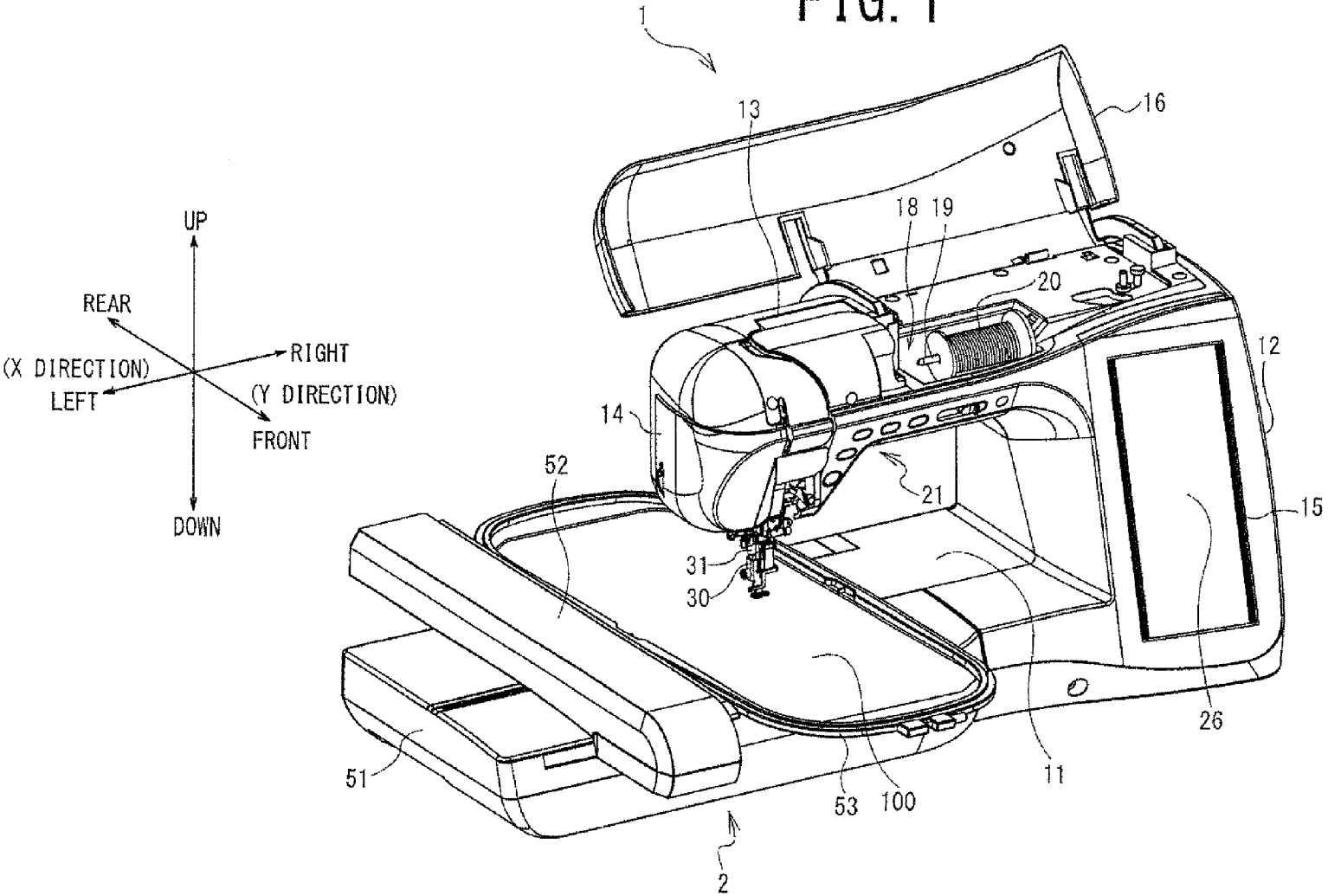
FIG. 1 is an oblique view of a sewing machine.

Hereinafter, embodiments will be explained with reference to the drawings. First, a physical configuration of a sewing machine 1 will be explained with reference to FIG. 1 and FIG. 2. The upper side, the lower side, the lower left side, the upper right side, the upper left side and the lower right side of FIG. 1 are respectively defined as the upper side, the lower side, the left side, the right side, the rear side, and the front side of the sewing machine 1. More specifically, a surface on which a plurality of operation switches 21 are arranged is the front face of the sewing machine 1. The longitudinal direction of a bed 11 and an arm 13 is the left-right direction of the sewing machine 1, and the side on which a pillar 12 is arranged is the right side. The extending direction of the pillar 12 is the up-down direction of the sewing machine 1.

The sewing machine 1 is provided with the bed 11, the pillar 12, and the arm 13. The bed 11 is a base portion of the sewing machine 1 and extends in the left-right direction. The pillar 12 extends upward from the right end of the bed 11. The arm 13 extends to the left from the upper end of the pillar 12 such that the arm 13 faces the bed 11. The left end of the arm 13 is a head 14. A needle plate (not shown in the drawings) is disposed on a top surface of the bed 11. Below the needle plate (namely, inside the bed 11), a feed dog (not shown in the drawings), a feed mechanism 87 (refer to FIG. 3), a shuttle mechanism (not shown in the drawings) and a feed adjustment motor 77 (refer to FIG. 3) are provided as structural elements of a sewing mechanism 89 (refer to FIG. 3) that forms stitches on a sewing workpiece 100. The feed dog may be driven by the feed mechanism 87, and may move the sewing workpiece (a work cloth, for example) by a predetermined feed distance. The feed distance of the feed dog may be adjusted by the feed adjustment motor 77. The shuttle mechanism is configured to entwine a needle thread with a bobbin thread below the needle plate.

Figure 2:
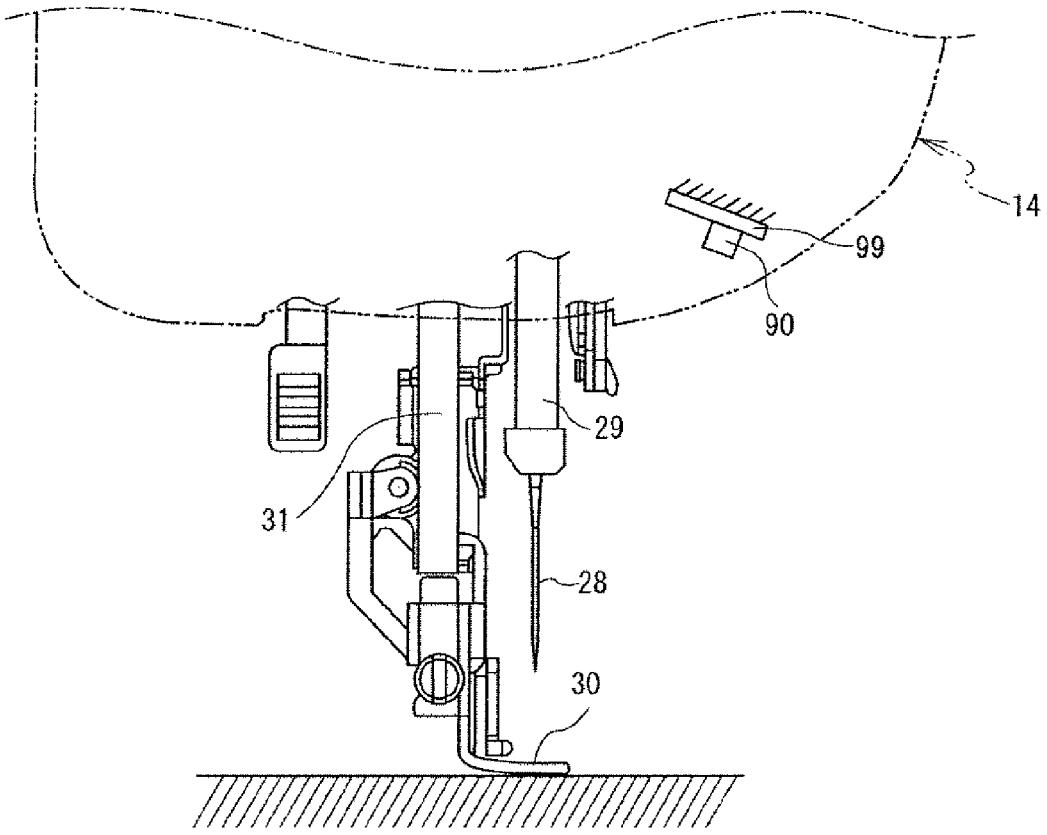
FIG. 2 is an explanatory diagram showing a lower end portion of a head and an internal configuration of the head.

As shown in FIG. 2, a needle bar 29 and a presser bar 31 extend downward from a lower end portion of the head 14. A sewing needle 28 may be replaceably attached to the lower end of the needle bar 29. A presser foot 30 may be replaceably attached to the lower end of the presser bar 31. The presser foot 30 may hold the sewing workpiece in place. A needle bar mechanism (not shown in the drawings), a needle swinging mechanism 88 (refer to FIG. 3) and a needle swinging motor 80 (refer to FIG. 3) and the like are provided on the head 14 as structural elements of the sewing mechanism 89 (refer to FIG. 3). The needle bar mechanism is configured to drive the needle bar 29 to move in the up-down direction. The needle bar mechanism may be driven by a drive shaft 81 (refer to FIG. 3) that may be driven by a sewing machine motor 79 (refer to FIG. 3). The needle swinging mechanism 88 is configured to swing the needle bar 29 in the left-right direction. The needle swinging mechanism 88 may be driven by the needle swinging motor 80.

An image sensor 90 is attached to the head 14, at a position forward of the needle bar 29 and slightly to the right of the needle bar 29 such that the image sensor 90 can capture an image of the entire needle plate (not shown in the drawings). The image sensor 90 is provided with a complementary metal oxide semiconductor (CMOS) sensor and a control circuit. The image sensor 90 is configured to generate image data that represents the image captured by the CMOS sensor. In the present embodiment, a support frame 99 is attached to a sewing machine frame (not shown in the drawings) of the sewing machine 1. The image sensor 90 is fixed to the support frame 99. The image data generated by the image sensor 90 may be used in main processing that will be described later.

As shown in FIG. 1, a cover 16 that can be opened and closed is provided on an upper portion of the arm 13. In FIG. 1, the cover 16 is in an open state. A thread housing portion 18 is provided below the cover 16, namely, inside the arm 13. The thread housing portion 18 is provided with a thread spool pin 19 that extends in the left-right direction. A thread spool 20 is housed in the thread housing portion 18 such that the thread spool pin 19 passes through the thread spool 20. The needle thread (not shown in the drawings) that is wound around the thread spool 20 is supplied to the sewing needle 28 attached to the needle bar 29 via a thread hook (not shown in the drawings) provided on the head 14. The plurality of operation switches 21 including a start/stop switch are provided on a lower portion of a front face of the arm 13.

A liquid crystal display (hereinafter referred to as an LCD) 15 is provided on a front face of the pillar 12. The LCD 15 displays an image that includes various items, such as commands, illustrations, setting values and messages. A touch panel 26 is provided on a front face side of the LCD 15. When a user performs a pressing operation (hereinafter this operation is referred to as a "panel operation") on the touch panel 26 using a finger or a dedicated stylus pen, which item is selected is recognized corresponding to the pressed position detected by the touch panel 26. Through this type of panel operation, the user can select a pattern to be sewn and a command to be executed.

A connector 38 (refer to FIG. 3) is provided on a right side surface of the pillar 12. An external storage device (not shown in the drawings), such as a memory card, can be connected to the connector 38. The sewing machine 1 can fetch embroidery data and various programs (which will be described later) from the external storage device connected to the connector 38.

The sewing machine 1 further includes an embroidery device 2. The embroidery device 2 can be mounted on and removed from the bed 11. FIG. 1 shows a state in which the embroidery device 2 is mounted on the sewing machine 1. When the embroidery device 2 is mounted on the sewing machine 1, the embroidery device 2 and the sewing machine 1 are electrically connected. When the embroidery device 2 and the sewing machine 1 are electrically connected, the embroidery device 2 may function as a part of the sewing mechanism 89 (refer to FIG. 3) of the sewing machine 1. The embroidery device 2 is provided with a body 51 and a carriage 52.

The carriage 52 is provided above the body 51. The carriage 52 has a rectangular parallelepiped shape that is long in the front-rear direction. The carriage 52 is provided with a frame holder (not shown in the drawings), a Y axis moving mechanism 86 (refer to FIG. 3) and a Y axis motor 84 (refer to FIG. 3). An embroidery frame 53 can be attached to and removed from the frame holder. Although not shown in the drawings, a plurality of types of the embroidery frame that are different in size and shape are prepared. The frame holder is provided on a right side surface of the carriage 52. Although not shown in detail, the embroidery frame 53 has a known structure and holds a sewing workpiece 100 between an inner frame and an outer frame of the embroidery frame 53. The sewing workpiece 100 held by the embroidery frame 53 may be arranged above the bed 11 and below the needle bar 29 and the presser foot 30. The Y axis moving mechanism 86 is configured to move the frame holder in the front-rear direction (Y direction). As the frame holder is moved in the front-rear direction, the embroidery frame 53 moves the sewing workpiece 100 in the front-rear direction. The Y axis motor 84 may drive the Y axis moving mechanism 86. A CPU 61 (refer to FIG. 3) of the sewing machine 1 may control the Y axis motor 84.

Figure 3:
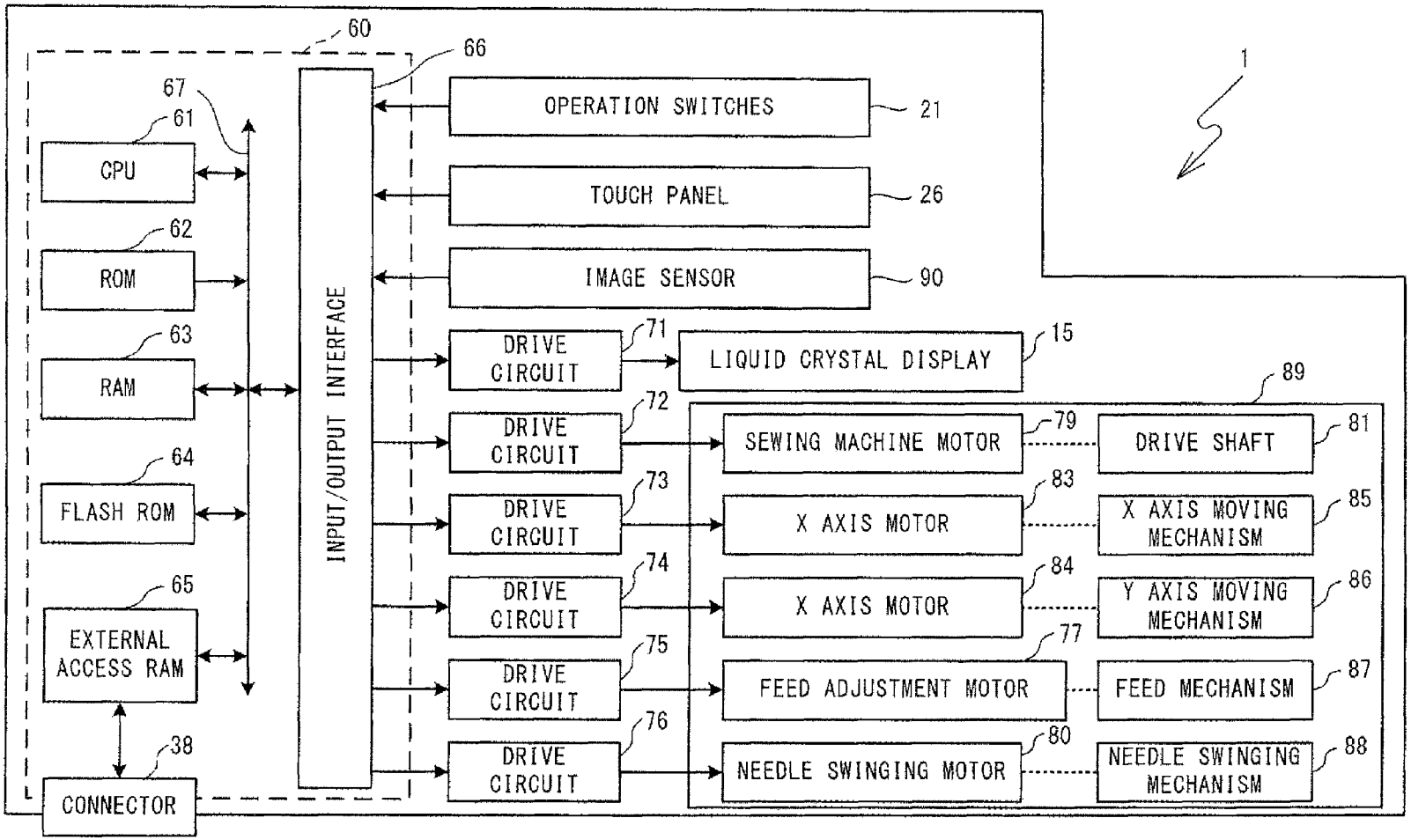
FIG. 3 is a block diagram that shows an electrical configuration of the sewing machine.

The body 51 is internally provided with an X axis moving mechanism 85 (refer to FIG. 3) that is configured to move the carriage 52 in the left-right direction (X direction) and an X axis motor 83 (refer to FIG. 3). As the carriage 52 is moved in the left-right direction, the embroidery frame 53 moves the sewing workpiece 100 in the left-right direction. The X axis motor 83 may drive the X axis moving mechanism 85. The CPU 61 of the sewing machine 1 may control the X axis motor 83.

The sewing mechanism 89 moves the embroidery frame 53 in the left-right direction (X direction) and the front-rear direction (Y direction), and drives the needle bar 29 shown in FIG. 2 and the shuttle mechanism (not shown in the drawings) synchronized with the motion of the embroidery frame 53, and thereby sews an embroidery pattern on the sewing workpiece 100 held by the embroidery frame 53. When a normal practical pattern that is not an embroidery pattern is sewn, the sewing is performed while the sewing workpiece 100 is being moved by the feed dog (not shown in the drawings) in a state in which the embroidery device 2 is removed from the bed 11.

An electrical configuration of the sewing machine 1 will be explained with reference to FIG. 3. A control portion 60 of the sewing machine 1 is provided with the CPU 61, a ROM 62, a RAM 63, a flash ROM 64, an external access RAM 65 and an input/output interface 66. The CPU 61, the ROM 62, the RAM 63, the flash ROM 64, the external access RAM 65 and the input/output interface 66 are mutually electrically connected via a bus 67. The ROM 62 may store data and various programs including a program that is used by the CPU 61 to execute the main processing that will be described later. The flash ROM 64 may store a plurality of types of embroidery data that are used by the sewing machine 1 to sew an embroidery pattern, and various types of parameters etc. to extract feature points from the image data generated by the image sensor 90. The connector 38 is connected to the external access RAM 65.

The operation switches 21, the touch panel 26, the image sensor 90 and drive circuits 71 to 76 are electrically connected to the input/output interface 66. The drive circuits 71 to 76 respectively drive the LCD 15, the sewing machine motor 79, the X axis motor 83, the Y axis motor 84, the feed adjustment motor 77 and the needle swinging motor 80.

Figure 4:
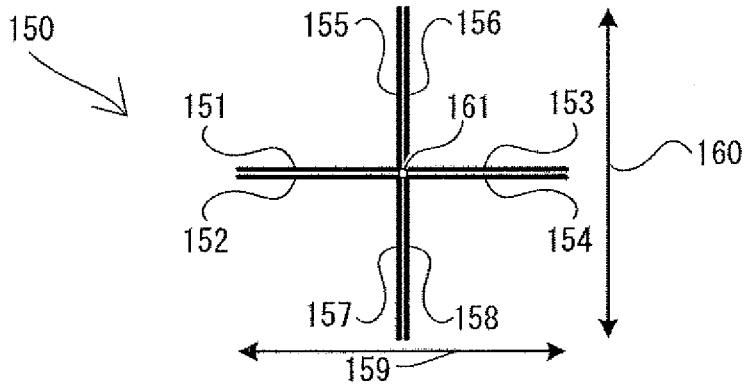
FIG. 4 is an explanatory diagram of a stitched marker.

A stitched marker 150 will be explained with reference to FIG. 4. The left-right direction and the up-down direction in FIG. 4 respectively correspond to the X direction and the Y direction of the sewing machine 1. The stitched marker 150 is formed by stitches, and may be used as a reference for at least one of a sewing position and a sewing angle of an embroidery pattern. In the present embodiment, the sewing position and the sewing angle of the embroidery pattern are represented by the stitched marker 150. At least one of the sewing position and the sewing angle of a pattern (stitches) is defined as a layout of the pattern (stitches). Particularly, in the present embodiment, the layout of the pattern (stitches) indicates the sewing position and the sewing angle of the pattern (stitches). When sewing of an embroidery pattern including a plurality of stitches is stopped in the main processing that will be described later, the stitched marker 150 is used as a reference to set the layout of a pattern to be sewn with respect to a sewn pattern. The sewn pattern includes at least one stitch that has been sewn among a plurality of stitches that form the embroidery pattern. The pattern to be sewn includes at least one stitch that has not been sewn among the plurality of stitches that form the embroidery pattern. As shown in FIG. 4, the stitched marker 150 has a cross shape and includes four stitches 151 to 154 that extend in the X direction and four stitches 155 to 158 that extend in the Y direction. The length of the stitched marker 150 in the X direction indicated by an arrow 159 and the length of the stitched marker 150 in the Y direction indicated by an arrow 160 may be each 4 mm, for example. The sewing position of the stitched marker 150 is set to a position where the stitched marker 150 will be covered by the embroidery pattern, in accordance with the main processing that will be described later. Unit data of the stitched marker 150 may be stored in the flash ROM 64. The unit data is data that represents relative coordinates to be used to sew the stitches 151 to 158 that form the stitched marker 150. The relative coordinates are represented by coordinates in an embroidery coordinate system. The embroidery coordinate system is a coordinate system of the X axis motor 83 and the Y axis motor 84 that may cause the carriage 52 to move. By using coordinates in the embroidery coordinate system, it is possible to represent a position on the sewing workpiece 100 held by the embroidery frame 53.

Figure 5:
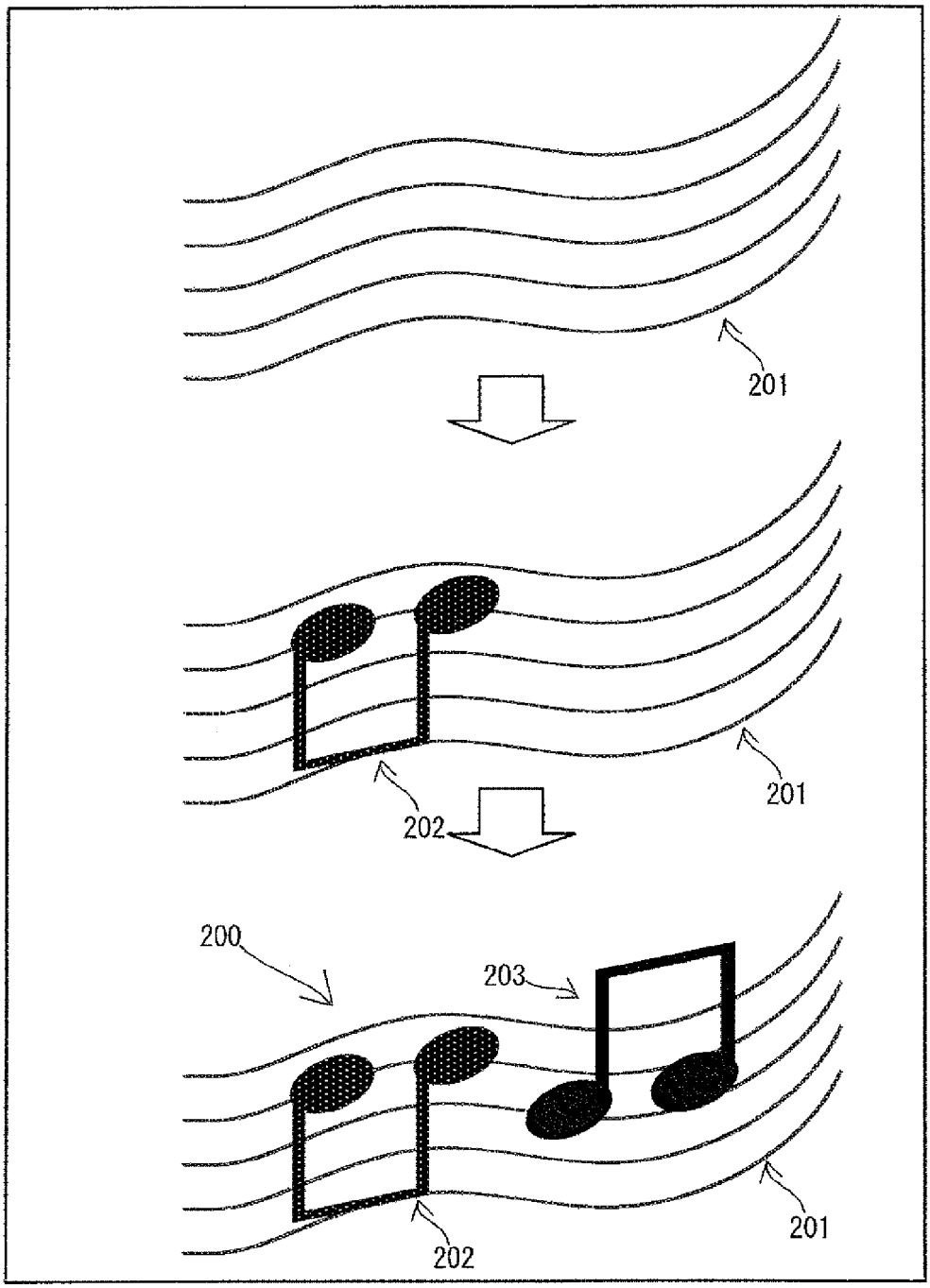
FIG. 5 is an explanatory diagram representing an order of sewing of embroidery patterns.

Using an embroidery pattern 200 as an example, the embroidery pattern formed by a plurality of stitches that can be sewn using the sewing machine 1 and the embroidery data will be explained with reference to FIG. 5. The user can select a desired embroidery pattern by the panel operation from among a plurality of embroidery patterns stored in the flash ROM 64 (refer to FIG. 3). The embroidery pattern 200 is an embroidery pattern that is sewn using three colors of thread. In accordance with the embroidery data, the embroidery pattern 200 is sewn in the order of a pattern 201 of a first color, a pattern 202 of a second color and a pattern 203 of a third color. The embroidery data to sew the embroidery pattern 200 includes a data number, coordinate data and thread color data. The data number represents the number of needle drop points from the start of sewing. The coordinate data is data that represents positions (specifically, needle drop points) of the stitches included in the embroidery pattern. For example, the coordinate data represents relative coordinates of an (N+1)-th needle drop point with respect to an N-th needle drop point, namely, an X axis movement amount and a Y axis movement amount of the embroidery frame 53, or represents absolute coordinates in the embroidery coordinate system of the stitches included in the embroidery pattern. The needle drop point is a position at which the sewing needle 28 pierces the sewing workpiece 100. The coordinate data defines the layout and the size of the embroidery pattern. The coordinate data of the embroidery data is corrected as appropriate when the layout and the size of the embroidery pattern with respect to the sewing workpiece 100 are changed. In the present embodiment, the embroidery coordinate system and a coordinate system for the whole of space (hereinafter referred to as a world coordinate system) are associated in advance. The sewing machine 1 has a function to correct the coordinate data represented by the embroidery coordinate system, using coordinates represented by the world coordinate system. The thread color data is data that represents the color of thread used to sew stitches.

Hereinafter, the main processing of the present embodiment will be explained with reference to FIG. 6 to FIG. 9. The main processing is started, for example, when the user selects an embroidery pattern by the panel operation and inputs a command to start sewing of the embroidery pattern after editing the embroidery pattern and specifying the layout of the embroidery pattern. When the main processing is started, the sewing workpiece 100 is held by the embroidery frame 53 and the embroidery frame 53 is mounted on the embroidery device 2. When the main processing is started, the thread of the first color of the embroidery pattern is mounted on the sewing machine 1. The program to perform the main processing is stored in the ROM 62 (refer to FIG. 3) and is performed by the CPU 61. In the explanation below, an image represented by the image data that is generated by the image sensor 90 and is output to the control portion 60 is referred to as a captured image. The data that is acquired or calculated in the course of performing the main processing is stored in the RAM 63, as appropriate. As a specific example, a case will be explained in which the sewing workpiece 100 is removed from the embroidery frame 53 in the middle of sewing the embroidery pattern 200.

Figure 6:
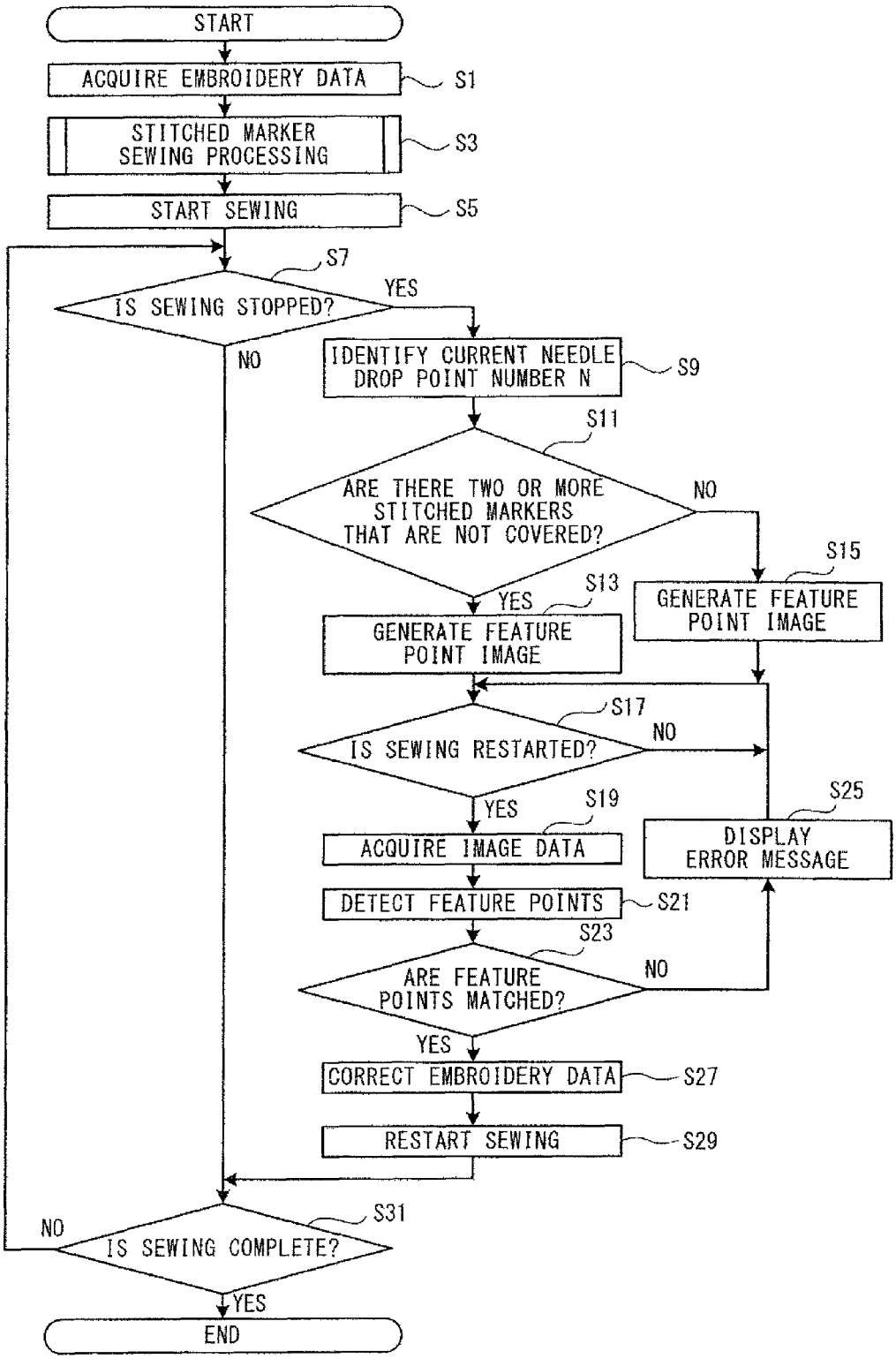
FIG. 6 is a flowchart of main processing.

As shown in FIG. 6, in the main processing, the CPU 61 acquires, from the flash ROM 64, the embroidery data to sew the embroidery pattern 200 selected by the user (step S1). The editing and the specified layout of the embroidery pattern are reflected in the embroidery data acquired by the processing at step S1. Next, the CPU 61 performs stitched marker sewing processing (step S3). In the stitched marker sewing processing of the present embodiment, the CPU 61 generates stitched marker data that is data to sew the stitched marker 150 in a position where the stitched marker 150 will be covered by the embroidery pattern 200. The CPU 61 controls the sewing mechanism 89 (refer to FIG. 3) to sew the stitched marker 150 in accordance with the generated stitched marker data. When the sewing position of the stitched marker 150 is set, the CPU 61 arranges a reference point of the stitched marker 150 at an inside position of the embroidery pattern 200 and determines whether the stitched marker 150 will be covered by the embroidery pattern 200 under the condition that the stitched marker 150 is formed according to the position of the reference point. The inside position of the embroidery pattern 200 is a position inside the embroidery pattern 200 including the contour of the embroidery pattern 200. The reference point of the stitched marker 150 is a point that represents the sewing position of the stitched marker 150. When the CPU 61 determines that the stitched marker 150 will be covered by the embroidery pattern 200, the CPU 61 generates the stitched marker data to sew the stitched marker 150 whose reference point is arranged at the inside position. The CPU 61 preferentially reads out, from among the plurality of needle drop points represented by the embroidery data, the coordinates of the needle drop point that comes later in a sewing order, and sets the coordinates as the reference point of the stitched marker 150. Hereinafter, the stitched marker sewing processing will be explained in detail with reference to FIG. 7.

Figure 7:
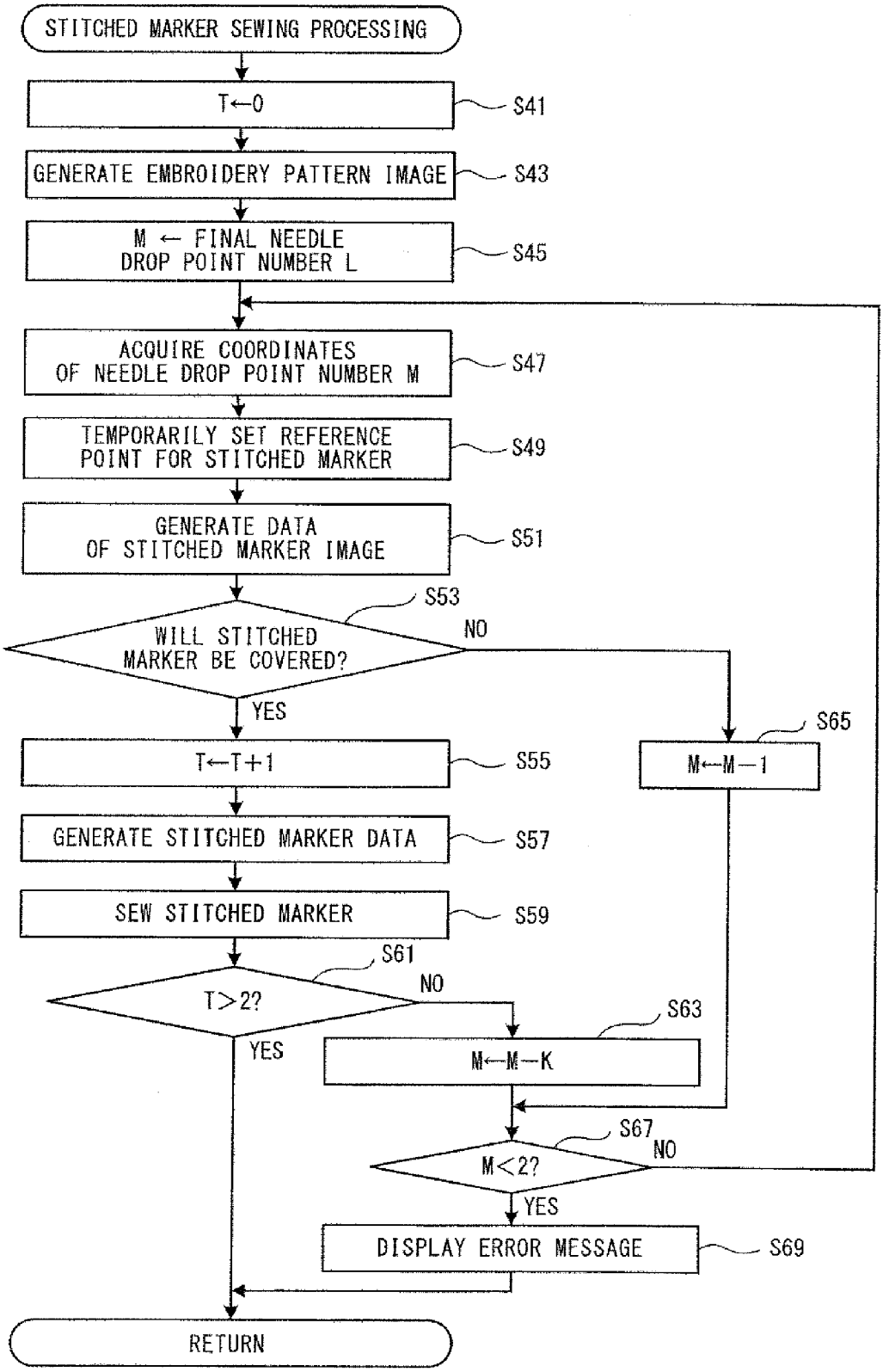
FIG. 7 is a flowchart of stitched marker sewing processing that is performed in the main processing shown in FIG. 6.
Figure 8:
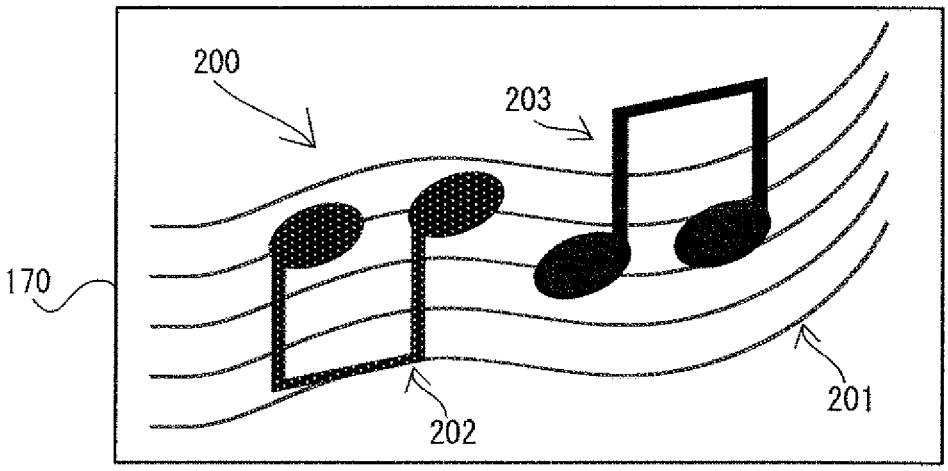
FIG. 8 is an explanatory diagram of an embroidery pattern image that is represented by data that is generated by the stitched marker sewing processing shown in FIG. 7.

As shown in FIG. 7, the CPU 61 sets a variable T to 0 (step S41). The variable T is a variable used to count the number of the stitched markers 150 that have already been set. Next, the CPU 61 generates data of an embroidery pattern image based on the embroidery data acquired by the processing at step S1 shown in FIG. 6 (step S43). The embroidery pattern image is an image that represents the finished embroidery pattern 200 when the embroidery pattern 200 is sewn in accordance with the embroidery data. When the coordinate data of the embroidery data represents the X axis movement amount and the Y axis movement amount of the embroidery frame 53, the CPU 61 identifies the coordinates of the needle drop point in the embroidery coordinate system for each data number, based on the coordinate data. When the coordinate data of the embroidery data represents the coordinates in the embroidery coordinate system, this processing is omitted. Next, the CPU 61 represents the stitches included in the embroidery pattern 200 as line segments connecting the needle drop points of the respective data numbers, to generate data of the embroidery pattern image. As a specific example, data that represents an embroidery pattern image 170 shown in FIG. 8 is generated based on the embroidery data of the embroidery pattern 200.

Figure 9:
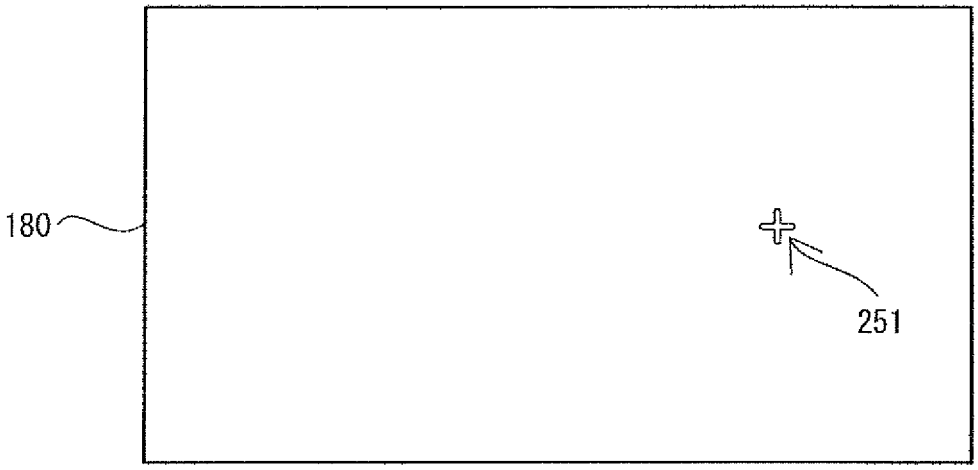
FIG. 9 is an explanatory diagram of a stitched marker image that is represented by the data that is generated by the stitched marker sewing processing shown in FIG. 7.

Next, the CPU 61 sets a final needle drop point number L as a needle drop point number M (step S45). The needle drop point number M is a variable used to preferentially read out, from among the plurality of needle drop points represented by the embroidery data, the coordinates of the needle drop point that comes later in the sewing order. The final needle drop point number L is a maximum value of the data numbers included in the embroidery data. Next, from among the coordinates of the needle drop points identified by the processing at step S43, the CPU 61 acquires coordinates of the needle drop point number M (the data number is M) (step S47). Next, the CPU 61 temporarily sets the coordinates acquired at step S47 as the coordinates of the reference point of the stitched marker 150 (step S49). In the present embodiment, a center point 161 (refer to FIG. 4) of the stitched marker 150 is used as the reference point of the stitched marker 150. As a result of the processing at step S49, the reference point of the stitched marker 150 is temporarily arranged at the inside position. Next, the CPU 61 generates data of a stitched marker image based on the unit data of the stitched marker 150, the coordinates acquired at step S47 and an extra length that is set in advance (step S51). The stitched marker image is an image that represents the finished stitched marker 150 when the stitched marker 150 is sewn in a position where the reference point of the stitched marker 150 matches the coordinates acquired at step S47. The stitched marker image is used in processing that sets the sewing position of the stitched marker 150 to a position where the stitched marker 150 will be covered by the embroidery pattern 200. The extra length is an excess length that is set in advance in order to set the sewing position of the stitched marker 150 to a position where the stitched marker 150 will completely be covered by the embroidery pattern 200. The extra length of the present embodiment may be 1 mm. The CPU 61 sets the size of the stitched marker 150 in the X direction and the Y direction such that the size is increased by an amount corresponding to the extra length, and then generates data of the stitched marker image. As a specific example, data that represents a stitched marker image 180 shown in FIG. 9 is generated.

Next, the CPU 61 determines whether the stitched marker 150 will be covered by the embroidery pattern 200 when the stitched marker 150 is formed in the position temporarily set at step S49 (step S53). Based on the data generated at step S43 and step S51, the CPU 61 overlaps the embroidery pattern image 170 and the stitched marker image 180, and when the whole stitched marker 150 is overlapped with the embroidery pattern 200, the CPU 61 determines that the stitched marker 150 will be covered by the embroidery pattern 200. In the present embodiment, particularly, when the whole stitched marker 150 is overlapped only with stitches of the same thread color as the stitch of the needle drop point number M, it is determined that the stitched marker 150 will be covered by the embroidery pattern 200. As shown by an image 190 in FIG. 10, when the sewing position of the stitched marker 150 is indicated by a position 251 in FIG. 9 with respect to the sewing position of the embroidery pattern 200, the whole stitched marker 150 overlaps only with stitches of the pattern 203 of the third color (yes at step S53). Therefore, the CPU 61 increments the variable T by one (step S55). Next, based on the unit data of the stitched marker 150 and the coordinates acquired at step S47, the CPU 61 generates the stitched marker data to sew the T-th stitched marker 150 in the position indicated by the position 251 (step S57). The CPU 61 stores the needle drop point number M in the RAM 63 in association with the variable T. Through the processing at step S57, the data to sew the stitched marker 150 such that the reference point of the stitched marker 150 is arranged at a position inside the embroidery pattern 200 is generated as the stitched marker data.

Next, the CPU 61 controls the sewing mechanism 89 (refer to FIG. 3), to sew the stitched marker 150 based on the stitched marker data generated at step S57 (step S59). In the processing at step S59 of the present embodiment, a task of replacing the thread spool 20 is taken into consideration, and the thread of the first color of the embroidery pattern 200 is used to sew the stitched marker 150. The CPU 61 stores the color of the T-th stitched marker 150 in association with the variable T. Next, when the variable T is equal to or less than 2 (no at step S61), the CPU 61 sets the needle drop point number M to a value obtained by subtracting a constant K from the needle drop point number M (step S63). The constant K is a constant that is set in advance, considering setting the sewing position of each of the stitched markers 150 such that the plurality of stitched markers 150 do not overlap with each other. The constant K may be 50, for example.

Figure 10:
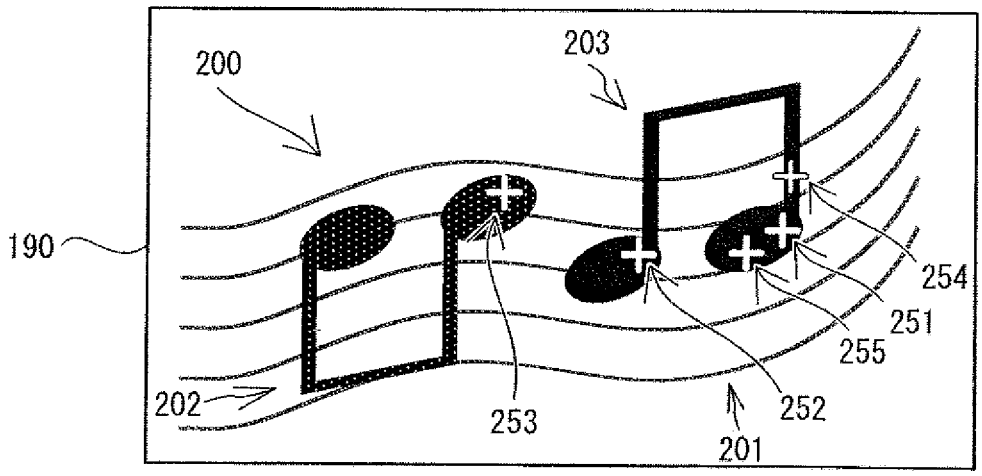
FIG. 10 is an explanatory diagram of an image obtained by overlapping the embroidery pattern image and the stitched marker image.

In the processing at step S53, when the sewing position of the stitched marker 150 with respect to the sewing position of the embroidery pattern 200 is shown by a position 254 on the image 190 in FIG. 10, the stitched marker 150 will be not covered by the embroidery pattern 200 (no at step S53). When the sewing position of the stitched marker 150 with respect to the sewing position of the embroidery pattern 200 is shown by a position 255 on the image 190 in FIG. 10, although the stitched marker 150 will be covered by the embroidery pattern 200, the stitched marker 150 overlaps with the pattern 201 of the first color, as well as overlapping with the pattern 203 of the third color of thread (no at step S53). In these cases, the CPU 61 decrements the needle drop point number M by one (step S65). After the processing at step S63 or the processing at step S65, if the needle drop point number M is equal to or more than 2 (no at step S67), the processing returns to step S47. When the needle drop point number M is less than 2 (yes at step S67), the CPU 61 controls the drive circuit 71 (refer to FIG. 3) and causes the LCD 15 to display an error message (step S69). The error message is displayed to notify the user of the fact that three of the stitched markers 150 cannot be formed. After the processing at step S69, the stitched marker sewing processing ends and the processing returns to the main processing shown in FIG. 6.

The processing at step S53 is repeatedly performed, and if, with respect to the sewing position of the embroidery pattern 200, the sewing position of the stitched marker 150 is sequentially set to three positions (i.e., the position 251, a position 252 and a position 253) shown in FIG. 10, it is determined that the variable T is more than 2 (yes at step S61). In this case, the stitched marker sewing processing ends here and the processing returns to the main processing shown in FIG. 6.

After the processing at step S3 in FIG. 6, the CPU 61 controls the sewing mechanism 89 (refer to FIG. 3) and causes the sewing of the embroidery pattern 200 to be started in accordance with the embroidery data acquired at step S1 (step S5). Next, the CPU 61 determines whether the sewing of the embroidery pattern 200 is stopped (step S7). In the processing at step S7 of the present embodiment, the CPU 61 determines that the sewing of the embroidery pattern 200 has been stopped in each of the following cases: when thread replacement is necessary; when the sewing workpiece 100 has been removed from the embroidery frame 53; and when the user performs the panel operation to command that the sewing of the embroidery pattern 200 be stopped. When the sewing has been stopped (yes at step S7), the CPU 61 identifies a current needle drop point number N (step S9). The current needle drop point number N is a maximum value of the data numbers corresponding to the sewn pattern.

Next, the CPU 61 determines whether the number of the stitched markers 150 that are not covered by the sewn pattern is two or more (step S11). Based on the current needle drop point number N identified at step S9 and on the needle drop point number M and the variable T stored at step S57 in FIG. 7, the CPU 61 sequentially determines whether the T-th stitched marker 150 is covered by the sewn pattern, and identifies the number of the stitched markers 150 that are not covered by the sewn pattern. The processing at step S11 is processing to identify the number of the stitched markers 150 that can be detected based on a captured image. In the present embodiment, taking account of detection accuracy of the stitched marker 150, the stitched marker 150 that is assumed not to overlap with the sewn pattern at all is taken as the stitched marker 150 that can be detected based on the captured image. Specifically, when a number obtained by adding a constant S to the current needle drop point number N is larger than the needle drop point number M that corresponds to the variable T, the CPU 61 determines that the T-th stitched marker 150 is covered by the sewn pattern. The constant S is a constant that is set in consideration of conditions that include the size of the stitched marker 150, the position of the reference point with respect to the whole stitched marker 150 and the length of the stitches of the embroidery pattern 200. The constant S may be 25, for example.

In the specific example, when the three stitched markers 150 are not covered by the sewn pattern (yes at step S11), the CPU 61 generates data that represents a feature point image based on the stitched marker data generated by the processing at step S57 in FIG. 7 (step S13). The feature point image is an image that represents positions of the feature points in the embroidery coordinate system. In the processing at step S13, the CPU 61 sets, as the feature points, the reference points of the stitched markers 150 that are not covered by the sewn pattern identified by the processing at step S11. The feature point image of the specific example is shown as in an image 260 in FIG. 11. The image 260 includes feature points 261 to 263 that correspond to the stitched markers 150 sewn in the positions 251 to 253 (refer to FIG. 10) based on the stitched marker data generated in the processing at step S57 in FIG. 7.

When the number of the stitched markers 150 that are not covered by the sewn pattern is smaller than 2 (no at step S11), the CPU 61 cannot set the layout (the sewing position and the sewing angle) of the pattern to be sewn, based on the positions of the stitched markers 150. To address this, the CPU 61 extracts feature points from a sewn pattern image, and generates data of the feature point image (step S15). The sewn pattern image is an image that represents the finished sewn pattern when the sewn pattern is sewn in accordance with the embroidery data. In the processing at step S15, when there is the stitched marker 150 that is not covered by the sewn pattern, the CPU 61 sets the reference point of the stitched marker 150 as a part of the feature points. The processing that extracts feature points from the sewn pattern image is performed in the following manner, for example. First, the CPU 61 generates, for the sewn pattern, data that represents the sewn pattern image, in the same manner as the data generated by the processing at step S43, based on the embroidery data acquired at step S1 and the current needle drop point number N identified at step S9. Next, based on the generated data, the CPU 61 performs image processing (known edge detection processing, for example) on the sewn pattern image, and extracts feature points (intersection points of line segments included in the image, for example). As an edge detection technique, a known method may be used, such as a method that performs first-order differentiation on the image and detects a position at which the gradient is maximum, or a method that performs second-order differentiation on the image and detects a zero crossing point. Through the processing at step S15, the CPU 61 generates the feature point image that represents a plurality of feature points.

Figure 12:
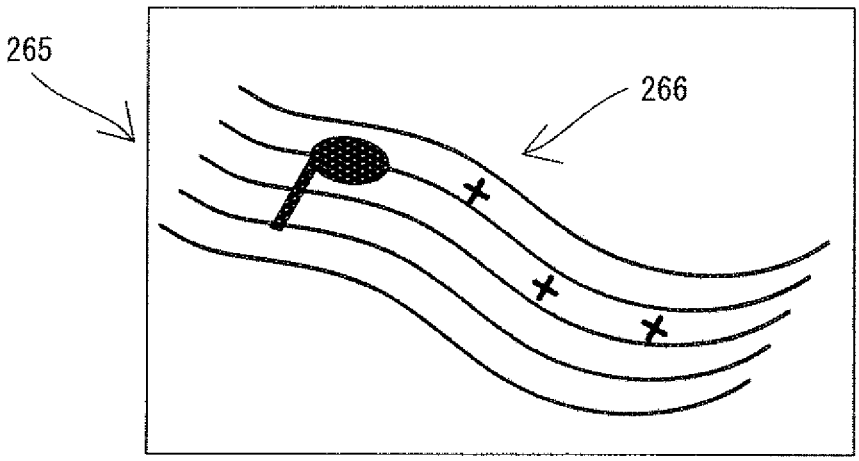
FIG. 12 is an explanatory diagram of a captured image that is represented by image data that is acquired by the main processing shown in FIG. 6.

Next, the CPU 61 stands by until a command to restart the sewing is input by the panel operation (no at step S17). When the command to restart the sewing is input by the panel operation (yes at step S17), the CPU 61 acquires image data output from the image sensor 90 (step S19). When an image capturing range of the image sensor 90 is smaller than a sewing area that is set inside the embroidery frame 53, there are cases in which the stitched marker 150 and the sewn pattern are not included in the captured image, depending on the position of the embroidery frame 53 with respect to the carriage 52. In this type of case, the relative position of the embroidery frame 53 may be appropriately changed until the stitched marker 150 and the sewn pattern are detected from the image data that represents the captured image. In the present embodiment, in order to simplify the explanation, a case will be explained in which the stitched marker 150 and the sewn pattern are included in the captured image represented by the image data acquired at step S19. As a specific example, a case will be explained which image data that represents a captured image 265 in FIG. 12 is acquired. In the specific example, a sewn pattern 266 is the pattern for which sewing is stopped in the middle of sewing the pattern 202 (refer to FIG. 5 or FIG. 8) of the second color.

Figure 13:
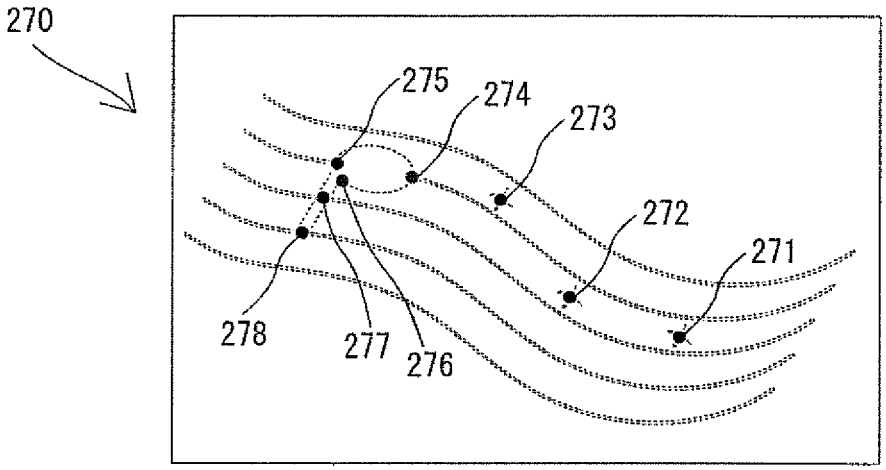
FIG. 13 is an explanatory diagram of an arrangement of a plurality of feature points that are detected based on the image data that represents the captured image shown in FIG. 12.

Next, the CPU 61 detects feature points based on the image data acquired by the processing at step S19 (step S21). Processing that detects the feature points from the image data may be performed, as appropriate, using a known method. For example, at step S21, the feature points are detected in accordance with the following procedure. First, the CPU 61 extracts, from the captured image, a color that is similar to the color of a detection target (at least one of the stitched marker 150 and the sewn pattern), and thereafter performs edge detection using a known method (the above-described method, for example) on the captured image. Next, the CPU 61 extracts feature points (intersection points of line segments included in the image, for example) from the detected edges. In the a specific example, the CPU 61 extracts feature points 271 to 278 shown on an image 270 of FIG. 13, based on the image data that represents the captured image 265 in FIG. 12. The feature points 271 to 278 indicate positions of the intersection points that are extracted based on the edges obtained by processing the image data.

Figure 11:
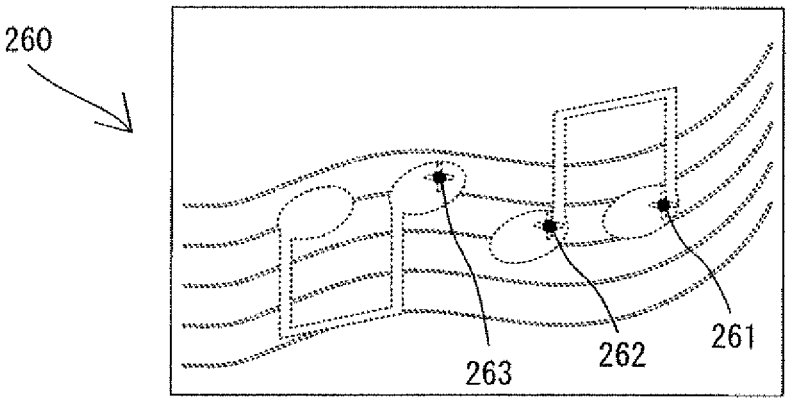
FIG. 11 is an explanatory diagram of a feature point image that is represented by data that is generated by the main processing shown in FIG. 6.

Next, the CPU 61 uses pattern matching to compare the feature points of the captured image and the feature point image generated in the processing at step S13 or step S15, and determines whether a pattern (a layout of a plurality of feature points) that matches feature points of the feature point image is included among the feature points of the captured image (step S23). For example, when a pattern that matches the feature points 261 to 263 of the image 260 in FIG. 11 is included among the feature points 271 to 278 extracted from the captured image 265 (yes at step S23), the CPU 61 corrects the embroidery data (step S27). In the specific example, the feature points 271 to 273 respectively correspond to the feature points 261 to 263. The CPU 61 identifies coordinates in the world coordinate system of the feature points 271 to 273 based on the image data acquired at step S19. A known method can be used, as appropriate, as a method for identifying the coordinates in the world coordinate system. For example, the coordinates in the world coordinate system may be identified using a method described in detail in Japanese Patent Application Publication No. JPA-2010-246885, relevant portions of which are herein incorporated by reference.

Figure 14:
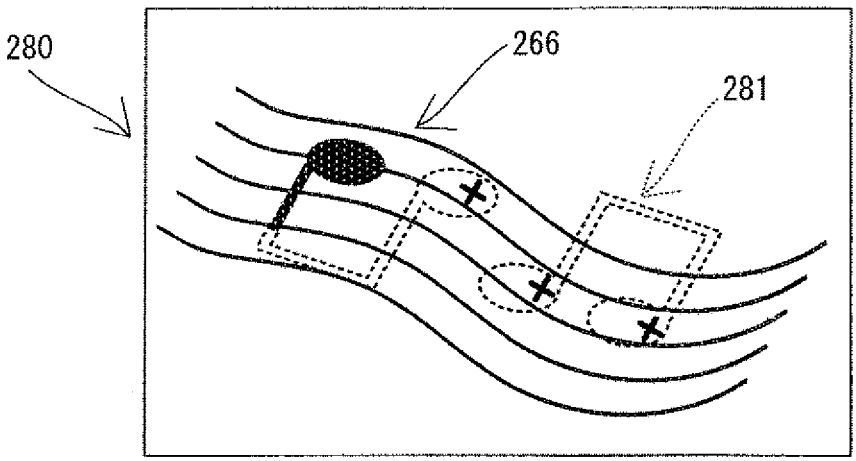
FIG. 14 is an explanatory diagram of processing that sets a sewing position and a sewing angle of a pattern to be sewn with respect to a sewn pattern.

For example, the CPU 61 uses the feature point 261 as a reference for the sewing position, and sets the sewing position of the pattern to be sewn based on the coordinates of the feature point 261 and the feature point 271. The CPU 61 sets the sewing angle of the pattern to be sewn based on, for example, an inclination of a line segment that connects the feature point 261 and the feature point 263 and an inclination of a line segment that connects the feature point 271 and the feature point 273 in the embroidery coordinate system. At this time, the position of the feature point 262 with respect to the line segment that connects the feature point 261 and the feature point 263, and the position of the feature point 272 with respect to the line segment that connects the feature point 271 and the feature point 273 are taken into consideration. In the specific example, based on the layout of the three stitched markers 150, the CPU 61 sets the sewing position and the sewing angle of a pattern 281 to be sewn with respect to the layout of the sewn pattern 266, as shown by an image 280 in FIG. 14, and corrects data that is included in the embroidery data and that is used to sew the pattern 281 to be sewn. Next, the CPU 61 controls the sewing mechanism 89 (refer to FIG. 3), and causes the sewing mechanism 89 to sew the pattern 281 to be sewn in accordance with the embroidery data corrected at step S27 (S29). Specifically, the CPU 61 causes the sewing mechanism 89 to form stitches that correspond to the needle drop point number (N+1) onward. The needle drop point number (N+1) is the number following the needle drop point number N identified at step S9.

When the pattern that matches the feature points of the feature point image is not included in the feature points of the captured image (no at step S23), the CPU 61 controls the drive circuit 71 (refer to FIG. 3) and causes the LCD 15 to display an error message (step S25). After that, the processing returns to step S17. The error message is displayed to notify the user of the fact that the layout of the pattern 281 to be sewn cannot be set based on the image data, and to prompt the user to redo the operation to cause the embroidery frame 53 to clamp the sewing workpiece 100. The error message is, for example, "There is no corresponding image on the cloth. Please re-attach the cloth".

When the sewing is not stopped in the processing at step S7 (no at step S7), or after processing at step S29, when the sewing of the embroidery pattern 200 is not complete (no at step S31), the processing returns to step S7. When the sewing of the embroidery pattern 200 is complete (yes at step S31), the main processing ends there.

With the sewing machine 1 of the present embodiment, when the position of the pattern 281 to be sewn is adjusted with respect to the sewn pattern 266, it is possible to automatically set the layout of the pattern 281 to be sewn with respect to the sewn pattern 266. Since the stitched markers 150 are covered by the embroidery pattern 200, there is no need to remove the stitched markers 150 after the sewing. Since the stitched markers 150 are covered by the embroidery pattern 200, the stitched markers 150 do not degrade the appearance of the embroidery pattern 200. When the stitched markers 150 are detected, the sewing machine 1 can detect the position of each of the stitched markers 150 on the sewing workpiece 100 based on the image data generated by capturing an image of the stitches formed on the sewing workpiece 100. The sewing machine 1 sews a plurality of the stitched markers 150 for the single embroidery pattern 200. Therefore, the sewing machine 1 can accurately set the layout of the pattern 281 to be sewn, in comparison to a case in which the layout of the pattern 281 to be sewn is set based on a single stitched marker. For that reason, the sewing machine 1 can improve the appearance of the finished embroidery pattern, in comparison to the case in which the layout of the pattern 281 to be sewn is set based on a single stitched marker. In the present embodiment, the three stitched markers 150 are sewn for the single embroidery pattern 200. It is therefore possible to set the sewing angle with even greater accuracy, in comparison to a case in which the number of the stitched markers 150 is two.

When the processing that detects the stitched markers 150 is performed, if the number of the stitched markers 150 that are not covered by the sewn pattern 266 is less than 2 (no at step S11), feature points are extracted also from the sewn pattern image. Therefore, in comparison to a case in which the layout of the pattern 281 to be sewn is set based on a single feature point, the sewing machine 1 can accurately set the layout of the pattern 281 to be sewn and can thus improve the finished appearance of the embroidery pattern 200. When the stitched marker 150 is not detected, the sewing machine 1 can set the layout of the pattern 281 to be sewn based on the layout of the sewn pattern 266. Therefore, regardless of whether the stitched markers 150 are covered by the sewn pattern 266 at a point in time at which the sewing of the embroidery pattern 200 is stopped, it is possible to easily adjust the position of the pattern 281 to be sewn with respect to the sewn pattern 266.

Through the processing at step S43, step S45, step S47, step S49, step S51, step S53, step S57, step S63 and step S65 in FIG. 7, the sewing machine 1 can set the sewing position of the stitched marker 150 to a position where the stitched marker 150 will be covered by the embroidery pattern 200, using a relatively simple procedure. The sewing machine 1 can preferentially form the stitched marker 150 that will be covered by stitches to be formed later in the sewing order. Thus, in comparison to a case in which the stitched marker 150 is covered by stitches that are fanned relatively early in the sewing order, it is possible to reduce the possibility that the stitched marker 150 is covered by the embroidery pattern 200 at a point in time at which the sewing of the embroidery pattern 200 is stopped. Therefore, the sewing machine 1 can reduce the possibility that the stitched marker 150 cannot be used for position adjustment of the pattern 281 to be sewn due to the fact that the stitched marker 150 is completely covered by the embroidery pattern 200 at the point in time at which the sewing of the embroidery pattern 200 is stopped. In the processing at step S53, the sewing machine 1 determines that the stitched marker 150 will be covered by the embroidery pattern 200 when the whole stitched marker 150 overlaps only with stitches of the same thread color as the stitch of the needle drop point number M. This is because it is considered that the feature points can be more easily extracted from the image that represents the stitched marker 150 when the stitched marker 150 does not overlap with the embroidery pattern 200 at all. Thus, in comparison to a case in which the position to form the stitched marker 150 is set without considering the stitches that overlap with the stitched marker 150, the sewing machine 1 can reduce the possibility that the stitched marker 150 will overlap with the stitches of the embroidery pattern 200 at the point in time at which the sewing of the embroidery pattern 200 is stopped. For that reason, the sewing machine 1 can secure the accuracy of the processing that extracts feature points from the image that represents the stitched marker 150.

The sewing machine according to the present disclosure is not limited to the embodiments described above, and various types of modifications may be made. For example, the modifications (A) to (E) described below may be made as desired.

(A) The structure of the sewing machine 1 may be changed as appropriate according to need. For example, the structure of the sewing machine 1 may be applied to an industrial-use sewing machine and to a multi-needle sewing machine. The sewing machine 1 may be configured such that the embroidery device 2 is not removable from the sewing machine 1. The type and the layout of the image sensor 90 may be changed as appropriate. More specifically, the image sensor 90 may be an imaging element other than the CMOS image sensor, such as a CCD camera or the like. When image data is not used in the processing that detects the layout of the stitched markers 150, the imaging element may be omitted.

(B) In the stitched marker sewing processing shown in FIG. 7, the sewing machine 1 need not necessarily detect the layout of the stitched markers 150 based on the image data generated by the image sensor 90. For example, the sewing machine 1 may detect the layout of the stitched markers 150 using an ultrasonic pen that generates an ultrasonic wave and a detector that detects the ultrasonic wave. In this case, the user may press a pen tip of the ultrasonic pen against the center point 161 of the stitched marker 150 on the sewing workpiece 100. The sewing machine 1 may identify the coordinates in the world coordinate system of the stitched marker 150 by identifying the position of a transmission source of the ultrasonic wave.

(C) The color, the design, the shape, the size and the number of the stitched markers 150 can be changed as appropriate. For example, the stitched marker 150 may be sewn using a thread color other than the colors used to sew the embroidery pattern, such as a thread color that is determined taking into account a contrast with the sewing workpiece. When the stitched marker 150 indicates the sewing position, the shape of the stitched marker 150 may be a cross shape, a circle or a star shape, for example. The size of the stitched marker may be automatically changed, taking the size etc. of the embroidery pattern into account. The sewing machine 1 may sew at least one stitched marker with respect to one embroidery pattern. The stitched marker 150 may be used as a reference for at least one of the sewing position and the sewing angle of the embroidery pattern. For example, when arrow shaped stitches are used as a stitched marker, a single stitched marker may represent at least one of the sewing position and the sewing angle. In this case, for example, the direction indicated by the arrow may represent the angle of the embroidery pattern with respect to the reference, and the tip end of the arrow may represent the position of the reference point (the center point, for example) of the embroidery pattern with respect to the sewing workpiece. It is sufficient if the reference point of the stitched marker is a point that represents the sewing position of the stitched marker. The reference point of the stitched marker is not limited to a point on the stitched marker, such as the center point 161 of the stitched marker 150, and may be a point that is not on the stitched marker, such as a vertex of a rectangle in which the stitched marker 150 is inscribed.

(D) It is sufficient that the program that includes an instruction to execute the main processing is stored in a storage device included in the sewing machine 1 before the sewing machine 1 executes the program. The acquiring method and the acquiring route of the program, and the device that stores the program may each be changed as appropriate. Therefore, the program executed by the CPU 61 may be received from another device via a communication cable or wireless communication and may be stored in a storage device, such as the flash ROM 64. Examples of the other device include a personal computer (PC) and a server that is connected via a network. In a similar manner, it is sufficient that data, such as the embroidery data, is stored in a storage device included in the sewing machine 1 until the sewing machine 1 executes the program. The acquiring method and the acquiring route of the embroidery data and the device that stores the embroidery data may each be changed as appropriate. The data, such as the embroidery data, may be received from another device via a communication cable or wireless communication, and may be stored in a storage device, such as the flash ROM 64.

(E) Each of the steps of the main processing shown in FIG. 6 and FIG. 7 is not limited to the example performed by the CPU 61, and some or all of the steps may be performed by another electronic device (an application-specific integrated circuit (ASIC), for example). Each of the steps of the main processing may be performed in a distributed manner by a plurality of electronic devices (a plurality of CPUs, for example). Each of the steps of the main processing may be performed in a different order or may be omitted, or another step may be added, if necessary. For example, the following modifications (E-1) to (E-3) may be made.

(E-1) In the processing at step S11 shown in FIG. 6, at a point in time at which the sewing of the embroidery pattern is stopped, the data of the feature point image to be generated by the CPU 61 need not necessarily be different depending on whether the number of the stitched markers that are not covered by the sewn pattern is two or more, and may be the same. More specifically, regardless of whether each of the stitched markers is covered by the embroidery pattern, the sewing machine 1 may generate a feature point image that represents feature points representing sewing positions of the stitched markers. In this case, when the generated feature point image does not match the feature points extracted from the captured image, the sewing machine 1 may extract feature points from the sewn pattern image or from the embroidery pattern image. Even when the sewing of the embroidery pattern is stopped (yes at step S7), if there is no need to reset the layout of the pattern to be sewn, the processing that sews the pattern to be sewn may be performed in accordance with the embroidery data. Based on the sewing position of at least one of the stitched marker and the sewn pattern, the sewing position of the pattern to be sewn may be set in accordance with the sewing position of the sewn pattern on the sewing workpiece. Based on the sewing angle of at least one of the stitched marker and the sewn pattern, the sewing angle of the pattern to be sewn may be set in accordance with the sewing angle of the sewn pattern on the sewing workpiece. Even in these cases, the sewing machine 1 can save the user the trouble of setting one of the sewing position and the sewing angle of the pattern to be sewn in accordance with the layout of the sewn pattern on the sewing workpiece.

(E-2) In the stitched marker sewing processing shown in FIG. 7, the coordinates of the needle drop points of the stitches of the embroidery pattern represented by the embroidery data need not necessarily be read out in the reverse order of sewing and set as the reference points of the stitched markers. The sewing machine 1 may read out the coordinates of the needle drop points of the stitches of the embroidery pattern represented by the embroidery data in the order of sewing, and may set the read-out coordinates as the reference points of the stitched markers. The sewing machine 1 may randomly read out the coordinates of the needle drop points of the stitches of the embroidery pattern represented by the embroidery data, and may set the read-out coordinates as the reference points of the stitched markers. The coordinates inside the embroidery pattern may be read out, in a predetermined order, as coordinates to be set as the reference points of the stitched markers. In this case, the predetermined order may be an order from the upper left to the lower right of the embroidery pattern image, for example.

(E-3) When the stitched marker is covered by the sewn pattern, the sewing machine 1 need not necessarily extract feature points from the sewn pattern and detect the layout of the sewn pattern with respect to the sewing workpiece. When the layout of the stitched marker cannot be detected as a result of, for example, the stitched marker being covered by the sewn pattern, the sewing machine 1 need not necessarily perform the processing that sets at least one of the sewing position and the sewing angle of the pattern to be sewn with respect to the sewn pattern.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a sewing device configured to form stitches on a sewing workpiece held by an embroidery frame;

a processor; and a memory configured to store computer-readable instructions that, when executed by the processor, instruct the processor to perform processes comprising:

acquiring embroidery data, the embroidery data being data to sew an embroidery pattern on the sewing workpiece, the embroidery pattern being formed by a plurality of stitches;

generating stitched marker data based on the acquired embroidery data, the stitched marker data being data to form at least one stitched marker in a position where the at least one stitched marker is covered by the embroidery pattern, and each of the at least one stitched marker being formed by at least one stitch used as a reference for at least one of a first sewing position and a first sewing angle of the embroidery pattern;

causing the sewing device to sew the at least one stitched marker in accordance with the generated stitched marker data;

causing the sewing device to start sewing the embroidery pattern in accordance with the acquired embroidery data;

identifying a pattern to be sewn when the sewing of the embroidery pattern is stopped, the pattern to be sewn having at least one stitch included in the plurality of stitches of the embroidery pattern and not yet sewn;

detecting at least one of a second sewing position and a second sewing angle of the at least one stitched marker on the sewing workpiece when the sewing of the embroidery pattern is stopped;

setting at least one of a third sewing position and a third sewing angle of the identified pattern to be sewn, in accordance with at least one of a fourth sewing position and a fourth sewing angle of a sewn pattern on the sewing workpiece, based on the detected at least one of the second sewing position and the second sewing angle, the sewn pattern having at least one sewn stitch that is included in the plurality of stitches of the embroidery pattern;

correcting data to be used to sew the pattern to be sewn included in the embroidery data based on the set at least one of the third sewing position and the third sewing angle; and causing the sewing device to restart sewing the embroidery pattern in accordance with the embroidery data including the corrected data for the pattern to be sewn.

2. The sewing machine according to claim 1, further comprising:

an imaging device configured to capture an image of at least a part of the sewing workpiece and to generate image data, wherein the computer-readable instructions further instruct the processor to perform processes comprising:

acquiring the image data generated by the imaging device when the sewing of the embroidery pattern is stopped, and wherein the detecting of the at least one of the second sewing position and the second sewing angle includes detecting the at least one of the second sewing position and the second sewing angle based on the acquired image data.

3. The sewing machine according to claim 1, wherein the generating of the stitched marker data includes generating data to form at least two of the stitched markers.

4. The sewing machine according to claim 1, wherein the generating of the stitched marker data includes:

determining, when setting the second sewing position of the at least one stitched marker, whether the at least one stitched marker is covered by the embroidery pattern when a reference point is arranged at an inside position, the inside position being a position inside the embroidery pattern including a contour of the embroidery pattern, and the reference point being a point that represents the second sewing position of the at least one stitched marker; and generating, when it is determined that the at least one stitched marker is covered by the embroidery pattern, the stitched marker data to sew the at least one stitched marker for which the reference point is arranged at the inside position.

5. The sewing machine according to claim 4, wherein the generating of the stitched marker data includes preferentially setting, as the inside position, a needle drop point that comes later in a sewing order from among a plurality of needle drop points represented by the embroidery data.

6. The sewing machine according to claim 1, wherein the computer-readable instructions further instruct the processor to perform processes comprising:

detecting at least one of the fourth sewing position and the fourth sewing angle when the sewing of the embroidery pattern is stopped; and wherein the setting at least one of the third sewing position and the third sewing angle includes setting at least one of the third sewing position and the third sewing angle, in accordance with the at least one of the fourth sewing position and the fourth sewing angle, based on the detected at least one of the second sewing position and the second sewing angle and on the detected at least one of the fourth sewing position and the fourth sewing angle.

7. A non-transitory computer-readable medium storing computer-readable instructions that, when executed, instruct a processor of a sewing machine to perform processes comprising:

acquiring embroidery data, the embroidery data being data to sew an embroidery pattern on a sewing workpiece held by an embroidery frame, the embroidery pattern being formed by a plurality of stitches;

generating stitched marker data based on the acquired embroidery data, the stitched marker data being data to form at least one stitched marker in a position where the at least one stitched marker is covered by the embroidery pattern, and each of the at least one stitched marker being formed by at least one stitch used as a reference for at least one of a first sewing position and a first sewing angle of the embroidery pattern;

causing a sewing device to sew the at least one stitched marker in accordance with the generated stitched marker data, the sewing device being configured to form stitches on the sewing workpiece held by an embroidery frame;

causing the sewing device of the sewing machine to start sewing the embroidery pattern in accordance with the acquired embroidery data;

identifying a pattern to be sewn when the sewing of the embroidery pattern is stopped, the pattern to be sewn having at least one stitch included in the plurality of stitches of the embroidery pattern and not yet sewn;

detecting at least one of a second sewing position and a second sewing angle of the at least one stitched marker on the sewing workpiece when the sewing of the embroidery pattern is stopped;

setting at least one of a third sewing position and a third sewing angle of the identified pattern to be sewn, in accordance with at least one of a fourth sewing position and a fourth sewing angle of a sewn pattern on the sewing workpiece, based on the detected at least one of the second sewing position and the second sewing angle, the sewn pattern having at least one sewn stitch that is included in the plurality of stitches of the embroidery pattern;

correcting data to be used to sew the pattern to be sewn included in the embroidery data based on the set at least one of the third sewing position and the third sewing angle; and causing the sewing device to restart sewing the embroidery pattern in accordance with the embroidery data including the corrected data for the pattern to be sewn.

8. The non-transitory computer-readable medium according to claim 7, wherein the computer-readable instructions further include instructions that instruct the processor to perform processes comprising:

acquiring the image data generated by an imaging device of at least a part of the sewing machine when the sewing of the embroidery pattern is stopped, the imaging device being configured to capture an image of the sewing workpiece and to generate image data; and wherein the detecting of the at least one of the second sewing position and the second sewing angle includes detecting, the at least one of the second sewing position and the second sewing angle based on the acquired image data.

9. The non-transitory computer-readable medium according to claim 7, wherein the generating of the stitched marker data includes generating data to form at least two of the stitched markers.

10. The non-transitory computer-readable medium according to claim 7, wherein the generating of the stitched marker data includes:

determining, when setting the second sewing position of the at least one stitched marker, whether the at least one stitched marker is covered by the embroidery pattern when a reference point is arranged at an inside position, the inside position being a position inside the embroidery pattern including a contour of the embroidery pattern, and the reference point being a point that represents the second sewing position of the at least one stitched marker; and generating, when it is determined that the at least one stitched marker is covered by the embroidery pattern, the stitched marker data to sew the at least one stitched marker for which the reference point is arranged at the inside position.

11. The non-transitory computer-readable medium according to claim 10, wherein the generating of the stitched marker data includes preferentially setting, as the inside position, a needle drop point that comes later in a sewing order from among a plurality of needle drop points represented by the embroidery data.

12. The non-transitory computer-readable medium according to claim 7, wherein the computer-readable instructions further instruct the processor to perform processes comprising:

the computer-readable instructions further include instructions that instruct the processor to perform processes comprising:

detecting at least one of the fourth sewing position and the fourth sewing angle when the sewing of the embroidery pattern is stopped; and wherein the setting at least one of the third sewing position and the third sewing angle includes setting at least one of the third sewing position and the third sewing angle, in accordance with the at least one of the fourth sewing position and the fourth sewing angle, based on the detected at least one of the second sewing position and the second sewing angle and on the detected at least one of the fourth sewing position and the fourth sewing angle.

* * * * *